US009446425B2

(12) United States Patent
Bibette et al.

(10) Patent No.: US 9,446,425 B2
(45) Date of Patent: Sep. 20, 2016

(54) ELEMENT FOR DELIVERING A FLUID COMPOSITION, ASSOCIATED DISPENSING DEVICE AND ASSOCIATED METHOD

(71) Applicant: CAPSUM, Marseilles (FR)

(72) Inventors: Jerome Bibette, Paris (FR); Mathieu Goutayer, Saint Malo (FR); Yan Pafumi, Gardanne (FR); Thomas Delmas, Marseilles (FR); Sebastien Bardon, Paris (FR); Ahmed Marouf, Cavaillon (FR)

(73) Assignee: CAPSUM, Marseilles (FR)

( * ) Notice: Subject to any disclaimer, the term of this patent is extended or adjusted under 35 U.S.C. 154(b) by 0 days.

(21) Appl. No.: 14/420,118

(22) PCT Filed: Aug. 14, 2013

(86) PCT No.: PCT/EP2013/067025

§ 371 (c)(1),
(2) Date: Feb. 6, 2015

(87) PCT Pub. No.: WO2014/027039

PCT Pub. Date: Feb. 20, 2014

(65) Prior Publication Data

US 2015/0209810 A1 Jul. 30, 2015

(30) Foreign Application Priority Data

Aug. 16, 2012 (FR) ..... 12 57833

(51) Int. Cl.
*B05B 11/00* (2006.01)
*B05B 15/00* (2006.01)
(Continued)

(52) U.S. Cl.
CPC ..... *B05B 11/3042* (2013.01); *B01F 3/12* (2013.01); *B01F 5/0688* (2013.01); *B01F 5/0694* (2013.01); *B01F 13/0022* (2013.01); *B05B 15/005* (2013.01); *B65D 83/32* (2013.01)

(58) Field of Classification Search
CPC ... B05B 11/3042; B05B 15/005; B01F 3/12; B01F 5/0688; B01F 5/0692; B01F 5/0694; B01F 13/0022; B65D 83/32
USPC ..... 222/145.5, 145.6, 1, 189.02, 189.06, 222/189.1, 189.11
See application file for complete search history.

(56) References Cited

U.S. PATENT DOCUMENTS 1,875,745 A * 9/1932 Marland ..... F16N 13/00 222/189.08
2,732,946 A 1/1956 Willy
(Continued)

FOREIGN PATENT DOCUMENTS

EP 0 900 744 A2 3/1999
FR 10 61404 A 4/1953
(Continued)

OTHER PUBLICATIONS

CAPSUM: "Modernist Serum La collection", Sep. 6, 2013, XP055089658, Marseille—France Retrieved from the Internet: URL:http://www.capsum.net/wp-content/uploa ds/2013/09/brochure-MS-opt.pdf [retrieved on Nov. 21, 2013] p. 3, figures.
(Continued)

*Primary Examiner* — Nicholas J Weiss
(74) *Attorney, Agent, or Firm* — Young & Thompson

(57) ABSTRACT

The device (110) for dispensing a fluid composition includes: a container (30) containing a heterogeneous mixture (14);
- a member (34) for dispensing the fluid composition;
- a delivery element (32) including:
  - a fluid guide conduit (42) defining an axis (A-A') for the flow of fluid through a central passage (50);
  - a filtration member (44) configured so that the heterogeneous mixture (14) inserted into the guide conduit (42) passes through the filtration member (44);
- the filtration member (44) including at least one openwork filtration wall (56) delimiting a plurality of filtration openings (58);
- the heterogeneous mixture (14) including particles (20) in suspension, the filtration openings (58) having a transverse expanse smaller than the mean diameter of the particles (20) in suspension; and
- the particles (20) in suspension being formed by beads.

19 Claims, 3 Drawing Sheets

(51) Int. Cl.

| | |
|---|---|
| ***B01F 5/06*** | (2006.01) |
| ***B65D 83/32*** | (2006.01) |
| ***B01F 13/00*** | (2006.01) |
| ***B01F 3/12*** | (2006.01) |

(56) References Cited

U.S. PATENT DOCUMENTS

| | | | | | |
|---|---|---|---|---|---|
| 3,291,184 | A * | 12/1966 | Varvel | F23K 5/18 | 13/590 |
| 4,035,303 | A * | 7/1977 | Ufferfilge | B65D 83/754 | 210/316 |
| 4,142,652 | A * | 3/1979 | Platt | B65D 83/54 | 222/189.06 |
| 4,882,055 | A * | 11/1989 | Stamstad | B01D 29/111 | 210/483 |
| 5,284,275 | A | 2/1994 | Shomer | | |
| 8,087,548 | B2 * | 1/2012 | Kimball | B05B 11/0059 | 128/200.23 |
| 8,376,192 | B2 * | 2/2013 | Maddy | B05B 15/005 | 222/382 |
| 2005/0133544 | A1 * | 6/2005 | Tadlock | B05B 11/0078 | 222/464.2 |
| 2009/0283545 | A1 | 11/2009 | Kimball | | |
| 2012/0003285 | A1 | 1/2012 | Bibette et al. | | |

FOREIGN PATENT DOCUMENTS

| | | | |
|---|---|---|---|
| JP | 2002 192005 | A | 7/2002 |
| WO | 2010/063937 | A1 | 6/2010 |

OTHER PUBLICATIONS

International Search Report, dated Dec. 2, 2013, from corresponding PCT application.

* cited by examiner

ELEMENT FOR DELIVERING A FLUID COMPOSITION, ASSOCIATED DISPENSING DEVICE AND ASSOCIATED METHOD

FIELD OF THE INVENTION

The present invention relates to an element for delivering a fluid composition, designed to be mounted in a container containing a heterogeneous mixture, comprising:

- a fluid guide conduit, comprising an upstream opening designed to open into the container, a central passage, and a downstream opening designed to be connected to a member for dispensing the fluid composition outside the container, the guide conduit defining a fluid flow axis through the central passage between the upstream opening and the downstream opening;
- a filtration member, mounted in the guide conduit, the filtration member being configured so that the heterogeneous mixture inserted into the guide conduit through the upstream opening passes through the filtration member.

Such an element is designed to form a fluid composition, for example able to be pumped through a product dispensing member, from a heterogeneous mixture forming a starting composition.

The heterogeneous mixture contains elements dispersed in a suspension, such as solid particles, or beads, for example formed by a liquid or gel core surrounded by a gel shell.

The fluid composition obtained from the heterogeneous mixture is advantageously designed to be used in the cosmetic, food and/or pharmaceutical field.

BACKGROUND OF THE INVENTION

To deliver a fluid composition from a heterogeneous or complex mixture, such as a viscous, heterogeneous or multiphasic solution, it is known to develop special pumps with high aspiration capacities or to use airless systems.

In fact, the pumps traditionally used in dispensing devices for food compositions are unsuitable for the aspiration of solutions containing solids in suspension. For example, solids in suspension may block the pump or damage it upon passage of the piston, making the dispensing device unusable for the user.

The pumps specifically developed to dispense heterogeneous mediums have many drawbacks. In particular, these pumps are very specific to a given application and have a very reduced usage range. This type of pump is therefore very costly.

U.S. Pat. No. 5,284,275 discloses an element for dispensing an adhesive composition formed from beads of a first product dispersed in a second product. The element comprises a guide conduit and a filtration wall perpendicular to the flow axis of the product. A piston pushes the beads toward the filtration wall, which causes them to break.

Such an element is not fully satisfactory. In fact, the breaking of the beads on the transverse wall quickly causes a risk of plugging of the filtration wall. The element disclosed in U.S. Pat. No. 5,284,275 is therefore suitable for a single use, and not to a multi-use dispensing device as for example in the cosmetic field.

SUMMARY OF THE INVENTION

One aim of the invention is therefore to provide an element for dispensing a fluid composition obtained from a heterogeneous medium, that is inexpensive and suitable for multiple uses, in the cosmetic, pharmaceutical or agri-food fields.

To that end, the invention relates to an element of the aforementioned type, characterized in that the filtration member comprises at least one openwork filtration wall delimiting a plurality of filtration openings, the filtration wall forming a non-zero angle with a perpendicular to the flow axis.

The element according to the invention may include one or more of the following features, considered alone or according to any technically possible combination(s):

- the filtration wall is inclined relative to a perpendicular to the flow axis, the filtration wall advantageously being inclined relative to the flow axis;
- the filtration member assumes a conical or frustoconical shape with an axis parallel to or combined with the flow axis;
- the filtration wall extends along the flow axis;
- the filtration wall has a cylindrical shape, with an axis parallel to or combined with the flow axis;
- each filtration opening has a size larger than 0.1 mm and advantageously smaller than 1 mm;
- the guide conduit has an upstream restrictor, positioned between the upstream opening and the filtration member, the guide conduit having a downstream segment with a transverse expanse, considered relative to the flow axis, larger than the transverse expanse of the upstream restrictor;
- a guide conduit comprises an inner protrusion protruding in the restrictor.

The invention also relates to a device for dispensing a fluid composition, characterized in that it comprises:

- a container, designed to contain a heterogeneous mixture;
- a delivery element as described above, positioned in the container, to convert the heterogeneous mixture into the fluid composition;
- a member for dispensing the fluid composition outside the device, the dispensing member being connected to the downstream opening of the delivery element.

The device according to the invention may include one or more of the following features, considered alone or according to any technically possible combination(s):

- the container comprises a heterogeneous mixture comprising particles in suspension, the filtration member having filtration openings with a transverse expanse smaller than the mean diameter of the particles in suspension, advantageously smaller than one third of the mean diameter of the particles in suspension;
- the particles in suspension are formed by beads comprising a core and a gelled envelope, the diameter of the beads advantageously being larger than 1 mm;
- the dispensing member is formed by a pump, in particular a ball pump, valve pump, membrane pump or piston pump.

The invention also relates to a method for dispensing a fluid composition, comprising the following steps:

- providing a device as described above, containing a heterogeneous mixture;
- actuating the dispensing member to drive the heterogeneous mixture into the delivery element;
- converting the heterogeneous mixture into the fluid composition in the filtration member;
- dispensing the fluid composition through the dispensing member outside the device.

The method according to the invention may include one or more of the following features, considered alone or according to any technically possible combination(s):

- the heterogeneous mixture comprises particles in suspension, the method comprising the disintegration of the particles in suspension in the delivery element to obtain the fluid composition;
- the disintegration of the particles in suspension is done before the passage in the filtration member, advantageously in an upstream restrictor of the guide conduit, the disintegration of the particles in suspension comprising the formation of a residue, the residue being retained on the filtration member.

BRIEF DESCRIPTION OF THE DRAWINGS

The invention will be better understood upon reading the following description, provided solely as an example and done in reference to the appended drawings, in which.

DETAILED DESCRIPTION OF THE INVENTION

In the rest of the description, the terms "upstream" and "downstream" are to be generally understood relative to the normal flow direction of a fluid.

Figure 1:
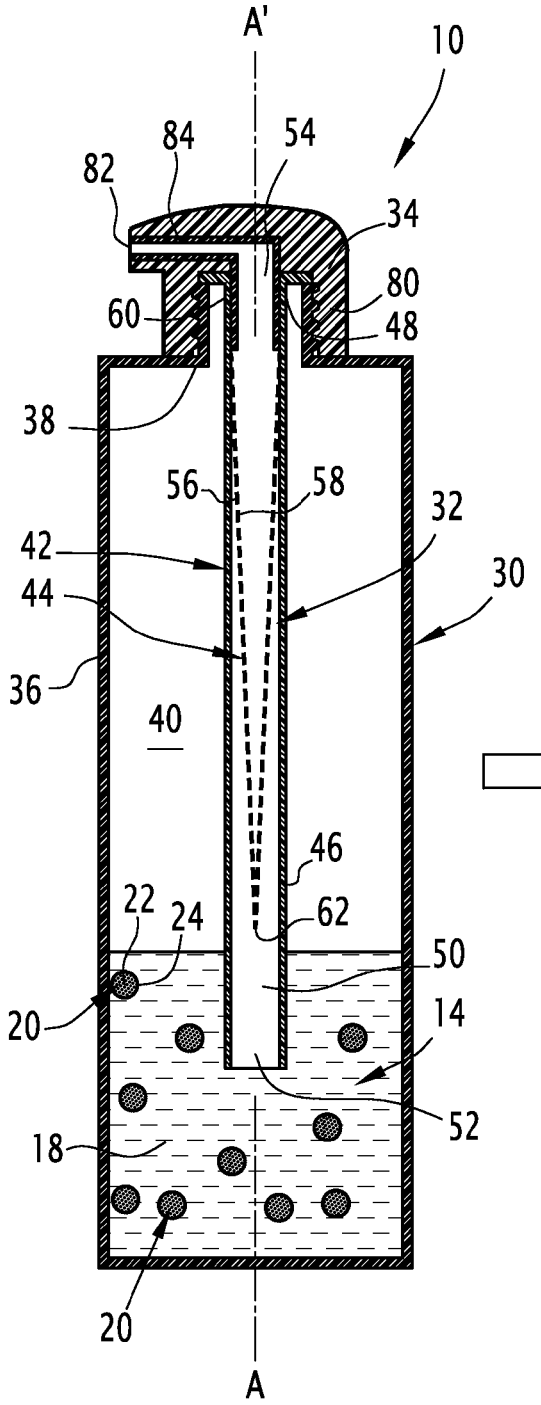
FIG. 1 is a diagrammatic sectional view in a vertical plane of a first dispensing device comprising a delivery element according to the invention, the device being idle.
Figure 2:
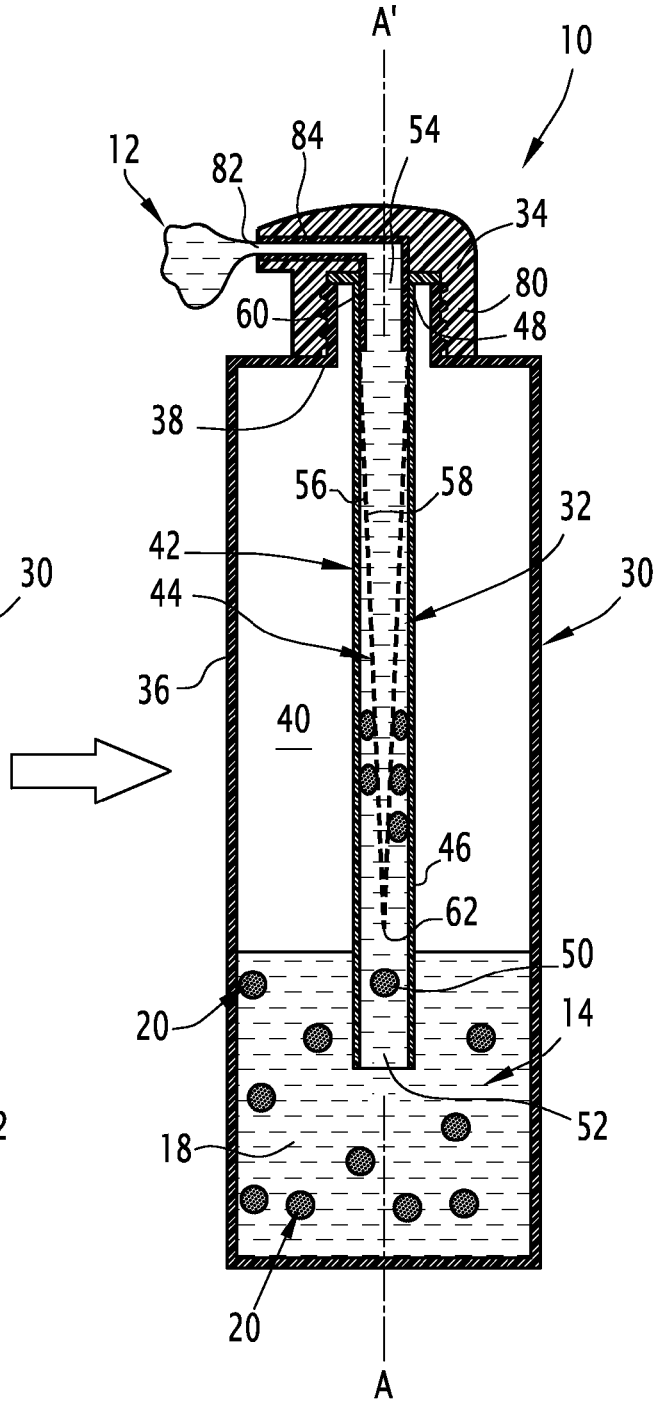
FIG. 2 is a view similar to FIG. 1, during delivery of the product.

A first device 10 for dispensing a fluid composition 12 according to the invention is illustrated by FIGS. 1 and 2.

This device 10 is designed to form and dispense the fluid composition 12 outside the device 10 from a heterogeneous mixture 14 contained in the device 10.

The fluid composition 12 is for example designed to form a gel, cream, foam, emulsion, mist, spray or aerosol. It contains at least one product chosen from a biologically active product, a cosmetic product, or a consumable comestible product.

When the product is a biologically active product, it is advantageously chosen from among anticoagulants, antithrombogenics, antibiotic agents, anti-proliferation, anti-adhesion, anti-migration agents, cell adhesion promoters, growth factors, antiparasitic molecules, anti-inflammatories, angiogenics, angiogenesis inhibitors, vitamins, hormones, proteins, antifungals, antimicrobial molecules, antiseptics or antibiotics.

Alternatively, the composition 12 contains reactive agents such as proteins or reagents.

A cosmetic product that may be contained in the composition 12 is for example cited in the COUNCIL DIRECTIVE dated Jul. 27, 1976 on the approximation of the laws of the Member States relating to cosmetic products (76/768/EEC/OJ L 262 dated Sep. 27, 1976, p. 169). This product is for example a cream, emulsion, lotion, gel and oil for the skin (hands, face, feet, etc.), a tinted base (liquid, paste, powder), a face mask, tinted bases (liquid, paste, powders), makeup powders, after-bath powders, hygienic powders, etc., toilet soaps, deodorant soaps, etc., perfumes, toilet waters and eau de cologne, bath and shower mixtures (salts, foams, oils, gels, etc.), hair care products: products for waving, straightening and fixing, cleansing products (lotions, powders, shampoos), conditioning products (lotions, creams, oils), hairdressing products (lotions, lacquers, brilliantines), a cleansing product (lotions, powders, shampoos), shaving products (creams, foams, lotions, etc.), products for making up and removing makeup from the face and eyes, products intended for application to the lips, products for nail care and makeup, products for external intimate hygiene, sunbathing products, products for tanning without sun, skin whitening products, anti-wrinkle products.

A comestible product contained in the composition 12, able to be consumed by a human being or an animal, is advantageously vegetable or fruit purées such as mango purée, pear purée, coconut purée, onion, pear or carrot cream, or other preparations that may mix several fruits or vegetables. Alternatively, these are oils such as a food oil, for example olive oil, soybean oil, grape seed oil, sunflower oil, or any other oil extracted from plants.

The fluid composition 12 is advantageously homogenous, without macroscopic particles in suspension. A "macroscopic particle" is in particular a particle with a minimum transverse size greater than 200 μm, in particular greater than 500 μm.

The fluid composition 12 thus advantageously assumes the form of a first pure liquid fluid, a solution of the fluid in a liquid solid, or a dispersion such as an emulsion or a fluid suspension in a liquid, the dispersed elements being invisible to the naked eye.

The viscosity of the fluid composition 12 is generally comprised between 500 mPa·s and 20,000 mPa·s. In particular, this viscosity is comprised between 2000 mPa·s and 15,000 mPa·s. This viscosity is measured using the following method.

A viscosimeter is used of the Brookfield DV-II type with a spindle with size (No.) 05. Approximately 150 g of composition is placed in a beaker with a volume of 250 ml, having a diameter of approximately 7 cm such that the height of the volume occupied by the 150 g of composition is sufficient to reach the gauge marked on the spindle. Next, the viscosimeter is started at a speed of 10 RPM and one waits for the value displayed on the screen to stabilize.

The heterogeneous mixture 14 comprises a continuous medium 18 and a plurality of particles in suspension 20.

The continuous medium 18 thus advantageously assumes the form of a first pure liquid fluid, a solution of a fluid in a liquid solid, or a dispersion such as an emulsion or a suspension of fluid in a liquid, the dispersed elements being invisible to the naked eye.

It may form a more or less viscous solution, a gel, a cream, or a foam, an emulsion, a mist, a spray or an aerosol.

The viscosity of the medium 18 is generally comprised between 500 mPa·s and 20,000 mPa·s. This viscosity is in particular comprised between 2000 mPa·s and 15,000 mPa·s. This viscosity is measured using the method described above.

The medium 18 contains at least one product chosen from among a biologically active product, a cosmetic product, or a consumable comestible product. These products are described above.

In the example shown in FIGS. 1 and 2, the dispersed particles 20 are formed by solid or semi-solid beads.

The particles 20 are positioned in a continuous medium 18.

The weight fraction of particles 20 in the heterogeneous medium 14, taken as the total mass of the particles 20 relative to the sum of the masses of the particles 20 and the continuous medium 18, is greater than 1%, advantageously greater than 10%, in particular greater than 20% or 50%.

The particles 20 are macroscopic. They are thus visible to the naked eye. The diameter of the particles 20 is for example greater than 1 mm, and is in particular comprised between 1 mm and 8 mm, in particular between 2 mm and 5 mm.

The particles 20 are advantageously deformable, in particular elastically or plastically deformable over a deformation range greater than 5% in compression between two planar surfaces.

Alternatively, the particles 20 are solid, and have a very low deformation, in particular less than 1%.

The deformation of the particles 20 is characterized by an increase in the area of the particles 20 following the application of a mass on a series of particles 20.

The observation is done using the following assembly:

The specimens comprising six particles are deposited on a transparent glass slide. A Vého Discovery VMS 001 camera connected to a computer is placed so as to be able to observe the bottom of the glass slide, and therefore the particles by transparency.

The acquisition software used is Astra Image WebCam Video Grabber. A first shot is recorded to be able to measure the initial area of the particles. Next, a second glass slide is deposited on the particles, and the weight is adjusted such that the mass of the second glass slide plus the ballast corresponds to 100 times the mass of the initial specimen (or 600 times the weight of a particle). A second shot is recorded 5 minutes after ballasting the second glass slide. The recorded shots are next exploited using the ImageJ software. The measurement of the areas before and after deformation are obtained in pixels. The value averaged over the number of specimens of the (final area−initial area)/initial area ratios corresponds to the deformation value.

In a first embodiment, the particles 20 are homogenous. They are for example formed by a continuous solid products such as cross-linked polymers (PMMA, PLGA, etc.), or solids (metal, metal oxide) covered with a deformable polymer layer such as the aforementioned polymers.

In the alternative illustrated by FIGS. 1 and 2, at least part of the particles 20 is formed by capsules comprising a fluid core 22 (see FIG. 1) and a gelled outer envelope 24. The capsules are for example capsules as described in patent application WO2010/063937 by the Applicant.

In this example, each capsule is spherical and advantageously has an outer diameter larger than 500 microns, and which is advantageously submillimetric.

The diameter of the capsules is generally smaller than 8 mm, and in particular comprised between 1 mm and 5 mm.

The core 22 contains at least one fluid advantageously chosen from among a biologically active product, a cosmetic product, or a consumable comestible product, as described above.

The viscosity of the core 22 is in particular below 50,000 mPa·s, and preferably below 30,000 mPa·s. The core 22 has a base of a primarily aqueous phase, or on the contrary a primarily oily phase.

The gelled envelope 24 of the capsules (see FIG. 1) advantageously comprises a gel containing water and at least one polyelectrolyte reactive to multivalent ions. In one advantageous alternative, the envelope 24 further contains a surfactant resulting from its manufacturing method.

"Polyelectrolyte reactive to multivalent ions" means, within the meaning of the present invention, a polyelectrolyte which may pass from a liquid state in an aqueous solution to a gelled state under the effect of contact with a gelling solution containing multivalent ions such as ions of an alkaline earth metal for example selected from among calcium ions, barium ions, magnesium ions.

In the liquid state, the individual polyelectrolyte chains are substantially free to flow relative to one another. An aqueous solution of 2 wt % polyelectrolyte then has a purely viscous behavior with shearing gradients characteristic of the shaping method. The viscosity of this solution is between 50 mPa·s and 20,000 mPa·s, advantageously between 3,000 mPa·s and 15,000 mPa·s measured with the method described earlier.

The individual polyelectrolyte chains in the liquid state advantageously have a molar mass greater than 65,000 g/moles.

In the gelled state, the individual polyelectrolyte chains form a coherent three-dimensional network with the multivalent ions which retains the core 40 and prevents it from flowing. The individual chains are retained relative to one another and cannot flow freely relative to one another. In that state, the viscosity of the formed gel is infinite. Further, the gel has a flow stress threshold. This stress threshold is greater than 0.05 Pa. The gel also has a non-zero elastic modulus greater than 35 kPa.

The three-dimensional polyelectrolyte gel contained in the envelope 24 confines water and the surfactant when it is present. The mass content of the polyelectrolyte in the envelope 24 is for example comprised between 0.5% and 5%.

The polyelectrolyte is preferably a biocompatible polymer which is harmless for the human body. It is for example produced biologically.

Advantageously, it is selected from among polysaccharides, acrylate-based synthesis polyelectrolytes (sodium, lithium, potassium or ammonium polyacrylate, or polyacrylamide), sulfonate-based synthesis polyelectrolytes (sodium poly(styrene sulfonate), for example). More particularly, the polyelectrolyte is selected from among an alkaline earth alginate, such as a sodium alginate or a potassium alginate, a gellan or a pectin.

The alginates are produced from so-called "Laminaria" brown algae, referred to as seaweed.

Such alginates advantageously have a α-L-guluronate content greater than about 50%, preferably greater than 55%, or even greater than 60%.

The surfactant is advantageously an anionic surfactant, a non-ionic surfactant, a cationic surfactant or a mixture thereof. The molecular mass of the surfactant is comprised between 150 g/mol and 10,000 g/mol, advantageously between 250 g/mol and 1,500 g/mol.

In the event that the surfactant is an anionic surfactant, it is for example selected from among an alkyl sulfate, an alkyl sulfonate, an alkylaryl sulfonate, an alkaline alkyl phosphate, a dialkylsulfosuccinate, an alkaline earth salt with saturated or unsaturated fatty acids. These surfactants advantageously have at least one hydrophobic hydrocarbon chain having a number of carbons greater than 5, or even 10, and at least one hydrophilic anionic group, such as a sulfate, sulfonate or a carboxylate bound to one end of the hydrophobic chain.

In the event that the surfactant is a cationic surfactant, it is for example selected from among an alkylpyridinium or alkylammonium halide salt, such as n-ethyldodecylammonium chloride or bromide, cetylammonium chloride or bromide (CTAB). These surfactants advantageously have at least one hydrophobic hydrocarbonaceous chain having a number of carbons greater than 5, or even 10, and at least one hydrophilic cationic group, such as a quaternary ammonium cation.

In the event the surfactant is a non-ionic surfactant, it is for example selected from among the polyoxyethylene and/or polyoxypropylene derivatives of fatty alcohols, fatty acids, or alkylphenols, arylphenols, or alkylglucosides, polysorbates, cocamides.

The surfactant mass content in the envelope 24 is greater than 0.001%, and is advantageously greater than 0.1%.

In this example, the envelope 24 is exclusively made up of polyelectrolyte, optionally surfactant, and water. The sum of the mass contents of polyelectrolyte, surfactant and water is then equal to 100%.

Alternatively, each capsule is of the type described in application FR 10 61404 by the Applicant. Each capsule then comprises a core 22 which contains an intermediate drop of an intermediate phase placed in contact with the gelled envelope 24. The core 22 comprises at least one inner drop of an inner phase positioned in the intermediate drop.

Advantageously, the particles 20 are mono-dispersed. "Mono-dispersed" means that they have a variation coefficient $C_v$ smaller than 10% in size.

To calculate the variation coefficient $C_v$, the mean diameter $\overline{D}$ of the particles is for example measured by analyzing a photograph of a lot made up of N particles, using image processing software (Image J). Typically, according to this method, the diameter is measured in pixels, then converted to μm, based on the size of the container containing the particles.

Preferably, the value of N is chosen to be greater than or equal to 30, such that this analysis provides a statistically significant reflection of the diameter distribution of the particles of said emulsion.

The diameter $D_i$ of each particle is measured, then the mean diameter $\overline{D}$ is obtained by calculating the arithmetic mean of these values $D_i$:

$$\overline{D} = \frac{1}{N}\sum_{i=1}^{N} D_i$$

From these values $D_i$, it is also possible to obtain the standard deviation σ of the diameters of the particles in the dispersion:

$$\sigma = \sqrt{\frac{\sum_{i=1}^{N}(D_i - \overline{D})^2}{N}}$$

In order to characterize the monodispersity of the particles according to this embodiment of the invention, it is possible to calculate the variation coefficient $C_v$:

$$C_v = \frac{\sigma}{\overline{D}}$$

The variation coefficient of the diameters of the particles of the population according to this embodiment of the invention is less than 10%, preferably less than 5%.

In one particular example, the continuous medium 18 is formed by a gelled solution, for example by an aqueous gel, in particular alone or in combination, a hyaluronic acid, xanthane, polysaccharide, cellulose, guar gum, or oligogeline gel.

The viscosity of the continuous medium 18 is greater than 1,000 mPa·s, in particular comprised between 3,000 mPa·s and 10,000 mPa·s.

The gel is thus viscous enough to allow the suspension of the particles 20. It is, however, not very real fluid fighting to allow it to be aspirated through the device 10, while being shear-thinning enough to drive the particles 20 with it when it is dispensed.

As illustrated by FIGS. 1 and 2, the device 10 comprises a container 30 containing the heterogeneous mixture 14, and a delivery element 32 according to the invention, mounted in the container 30 to form the fluid composition 12 from the heterogeneous mixture 14.

The device 10 further comprises a dispensing member 34 for dispensing the fluid composition 12 outside the device 10, connected to the delivery element 32.

In the example illustrated by FIGS. 1 and 2, the container 30 is formed by a tubular container 36 having a neck 38 on which the dispensing member 34 is mounted.

The container 30 delimits a hollow inner volume 40 accommodating the mixture 14 and the delivery element 32.

The hollow inner volume 40 is for example comprised between 0.01 $dm^3$ and 0.2 $dm^3$, in particular between 0.015 $dm^3$ and 0.1 $dm^3$.

According to the invention, the delivery element 32 comprises a fluid guide conduit 42, and a tangential filtration member 44, positioned in the guide conduit 42 to form the fluid composition 12.

The guide conduit 42 extends through the inner volume 40, advantageously up to the neck 38. Its height is generally greater than 90%, in particular greater than 95%, of the height of the container 30.

The guide conduit 42 comprises a hollow tubular body 46 and a fastening member 48 for fastening on the container 30. The fastening member 48 is configured to allow the guide conduit 42 to rest on the neck 38 of the container 30 and have a direct and tight connection with the dispensing member 34.

It delimits a central passage 50 defining an axis A-A' for the flow of fluid through the conduit 42. The conduit 42 further delimits an upstream opening 52 for withdrawing heterogeneous mixture 14 and a downstream opening 54 for delivering fluid composition 12, through which the central passage 50 emerges.

The hollow tubular body 46 is for example formed from a plastic material, which is advantageously flexible. In this example, the fastening member 48 comprises a collar mounted bearing on the neck 38 of the container 30.

In the example shown in FIGS. 1 and 2, the central passage 50 has a substantially constant section. It extends linearly along the axis A-A', vertically in FIGS. 1 and 2. Its transverse expanse is larger than the mean diameter of the particles 20, in particular larger than 2.5 times the mean diameter.

According to the invention, the filtration member 44 comprises at least one openwork filtration wall 56 delimiting filtration openings 58, forming a non-zero angle advantageously greater than 10° with a perpendicular to the flow axis A-A'.

In the example shown in FIGS. 1 and 2, the openwork filtration wall 56 has a conical shape. It thus forms an angle greater than 30°, advantageously greater than 45°, with the perpendicular to the flow axis A-A'. In this example, the openwork filtration wall 56 comprising a plurality of openings 58 is further inclined relative to the flow axis A-A', to provide tangential filtration.

The openwork filtration wall 56 protrudes in the downstream direction in the central passage 50. It has a base 60 with a section larger than or equal to that of the downstream opening 54 to surround the downstream opening 54 and a free end 62 positioned in the passage 50.

Thus, the filtration member 44 is arranged in the guide conduit 42 so that the entire heterogeneous mixture 14 introduced into the central passage 50 through the upstream opening 52 passes through the openwork wall 56 and its openings 58, before reaching the downstream opening 54. This allows the formation of the fluid composition 12 and the retention on the openwork wall 56 of the residues resulting from that formation.

No part of the heterogeneous mixture 14 can thus reach the downstream opening 54 without having passed through the openwork filtration wall 56.

In one alternative (not shown), the filtration member 44 has a cylindrical shape with axis A-A'. The filtration wall 56 also comprises at least one segment parallel to the axis A-A', capable of performing tangential filtration.

The length of the filtration member 44 is greater than 50% of the length of the central passage 50.

The filtration openings 58 are distributed along the axis A-A'. The transverse dimensions of the openings 58 are chosen to provide effective retention of the residues produced during disintegration of the particles 20, while avoiding plugging phenomena and providing an appropriate aspiration speed beyond the pressures exerted by the dispensing member 34.

Advantageously, the transverse dimension of the openings 58 is smaller than the mean diameter of the particles 20, and is advantageously smaller than one third of the mean diameter of the particles 20.

The dispensing member 34 is for example formed by a pump 80 capable of causing aspiration of the heterogeneous medium 14 in the delivery element 32, then causing that medium 14 to pass through the filtration member 44 to form the composition 12, and lastly conveying the composition 12 to a dispensing orifice 82 situated on the member 34 toward the outside of the device 10.

The pump is for example of the type with a bead, valve, membrane, or even piston.

In this example, the dispensing member 34 is connected to the delivery element 32. Thus, the downstream opening 54 emerges in the dispensing member 34, advantageously in a dispensing channel 84 connecting the downstream opening 54 to the dispensing orifice 82.

The operation of the first device 10 according to the invention will now be described.

Initially, the device 10 is provided. In its inner volume 40, the container 30 contains the heterogeneous mixture 14 comprising the particles 20 dispersed in the medium 18. The dispensing member 34 is inactive. The delivery device 32 is submerged in the mixture 14. The upstream opening 52 opens in the mixture 14.

When the user wishes to dispense the fluid composition 12, he actuates the dispensing member 34.

The dispensing member 34 then creates suction that spreads through the inner volume 50 of the delivery element 32.

The mixture 14 is then pumped through the upstream opening 52 and rises in the hollow tubular body 46 of the guide conduit 42 up to the filtration member 44.

In a first embodiment, when the particles 20 are rigid, they are locked against the wall 56 in the intermediate area delimited between the openwork wall 56 and the body 46 of that conduit 42. Only the homogenous liquid medium 18 passes through the filtration openings 58. The homogenous medium 18 thus forms the fluid composition 12, which rises through the downstream opening 54, the dispensing channel 84. This composition is extracted through the dispensing orifice 82 outside the device 10, for example in the form of a jet or spray.

In one alternative, the particles 20 disintegrate in contact with the openwork wall 56. Their content passes through the openings 58 and, by mixing with the medium 18, forms the fluid composition 12. The solid residue resulting from the separation of the particles 20 is locked by the openwork wall 56.

The delivery element 32 according to the invention therefore very effectively filters a heterogeneous mixture 14 to form a fluid composition 12 able to be dispensed in a standard, low-cost dispensing member 34.

Furthermore, the provision of a filtration member 44 producing tangential filtration avoids rapid plugging of that member 44 and allows the entire mixture 14 contained the container 30 to be dispensed, without risk of plugging.

A second device 110 according to the invention is illustrated by FIGS. 3 to 6. Unlike the first device 10, the guide conduit 42 of the delivery element 32 defines an upstream restrictor 112, extending between the upstream opening 52 and the filtration member 44, and a downstream segment 114 with a transverse expanse greater than the transverse expanse of the upstream restrictor 112.

Advantageously, the upstream restrictor 112 has a constant inner cross-section. Preferably, the transverse expanse of the restrictor 112 is comprised between one time and two times the mean diameter of the particles 20.

Figure 6:
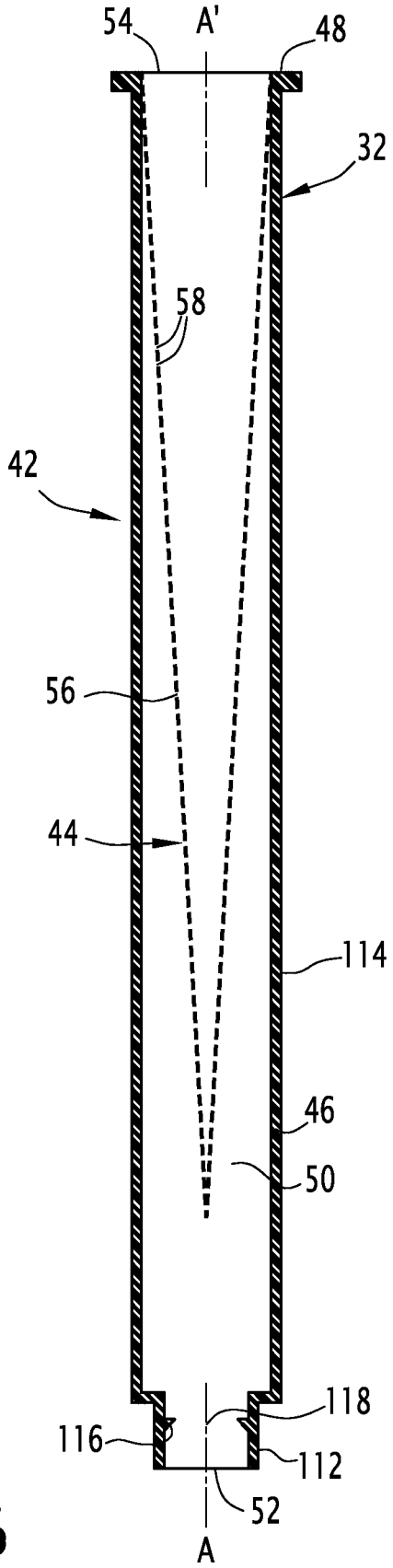
FIG. 6 is a sectional view along a vertical plane of the delivery element of the second device according to the invention.

In the example illustrated by FIG. 6, the upstream restrictor 112 further comprises an inner radial protrusion 116 designed to disintegrate the particles 20 to homogenize the heterogeneous medium 14.

The inner radial projection 116 is advantageously annular. It protrudes from the wall of the conduit 42 defining the restrictor 112. It defines a central aperture 118 for passage of the medium 14, with a transverse expanse smaller than the mean diameter of the particles 20 (see FIG. 6).

The height of the restrictor 112 is smaller than the height of the downstream segment 114, considered along the axis A-A'. This height is advantageously less than 50% of the height of the downstream segment 114, in particular less than 20% of the height of the downstream segment 114.

The downstream segment 114 receives the filtration member 44. In this example, the free end 62 of the openwork wall 56 is situated axially away from the restrictor 112 along the axis A-A'.

The minimum transverse expanse of the downstream segment 114 is greater than 1.5, in particular greater than 2.5 times the mean diameter of the particles 20. It is thus greater than 200%, in particular 300% of the minimum transverse expanse of the restrictor 112.

In this example, the downstream segment 114 has a substantially constant inner cross-section.

The operation of the second device according to the invention 110 differs from the operation of the first device 10 according to the invention in that the passage of the particles 20 in the restrictor 112 aligns the particles 20 to place them advantageously in a single file line, which facilitates their aspiration. The projection 116 present in the restrictor 112 then causes them to disintegrate.

In particular, when the particles are beads comprising a core 22 and an envelope 24, the envelope 24 of the particles 20 breaks in the restrictor 112 upon passage of the projection 116, releasing the core 22.

The core 22 therefore mixes with the medium 18 to form the fluid composition 12, which passes through the filtration member 44. The envelope 24 forms a semi-solid residue 120 that is retained by the filtration wall 56 without passing through the openings 58.

The delivery element 32 is therefore effective, both to form the fluid composition 12 by releasing the core 22 in the restrictor 112 and to retain the residue 120 remaining in the enclosure 24 very effectively.

In particular, the residue 120 of the envelopes 24 is retained little by little in the upper part of the filtration member 44. It thus accumulates without completely plugging the filtration member 44, until the entire content of the dispensing device 110 has been used.

Alternatively, at least part of the particles 20 disintegrate during the passage in the restrictor 112, in contact with the projection 116, and at least part of the particles 20 disintegrates in contact with the filtration member 44. Also alternatively, the particles 20 partially disintegrate during passage in the restrictor 112, in contact with the projection 116, and end up disintegrating in contact with the filtration member 44.

The suction provided by the dispensing member 34, in particular when that member 34 is a pump, is thus constant during use. A homogenous fluid composition 14 with no debris is thus delivered by the dispensing orifice 82, without producing debris unfavorable to the usage sensation upon touching the delivered composition, for example on a user's skin, or producing debris that may plug the dispensing member.

Advantageously, the volume of the upstream part of the central passage 50 situated upstream from the filtration member 44 in the central passage 50 is greater, and is in particular 1.5 times greater, than the maximum volume of the residues 120 designed to be recovered during the disintegration of the particles 20 in suspension.

The maximum volume of the residues 120 is for example estimated by the sum of all of the volumes of the envelopes 24 of the particles 20 contained in the heterogeneous mixture 14, received within the container 30.

The free volume in the skin filter thus makes it possible to store all of the semi-solid residues resulting from the disintegration and filtration of the initial heterogeneous mixture.

In the preceding, the term "disintegrate" preferably means that the particles are torn, exploded, opened and/or broken, thus losing their integrity and releasing their content if applicable, as opposed to the rupture of a mass of particles to obtain free particles retaining their own integrity.

As previously indicated, the volume delimited by the central passage and the filtration member 56 is 1.5 times greater than the maximum volume occupied by all of the residues 120 contained in the container 30.

Furthermore, the surface area of each filtration opening 58 is smaller than the minimum surface area of each residue 120.

The filtration openings 58 are advantageously elongated, with the smallest of the dimensions, here the width, smaller than one quarter of the diameter of the particles 20.

Thus, the openings have a significant surface area, which allows good retrieval of the product to be delivered, but are also fine enough to prevent the residues 120 from passing through the filter, even if they fold on themselves.

Preferably, the total surface area of the filtration openings 58 is greater than 0.2%, and in particular less than 10% of the total surface area of the residues 120 contained in the container 30.

In all of the preceding, the term "surface area" applied to a residue 120 means the maximum surface area among the set of surfaces areas measured over all of the projections of that residue 120 in a plane, advantageously on the filtration wall 56 of the filtration member 44.

Figures 3, 4, 5:
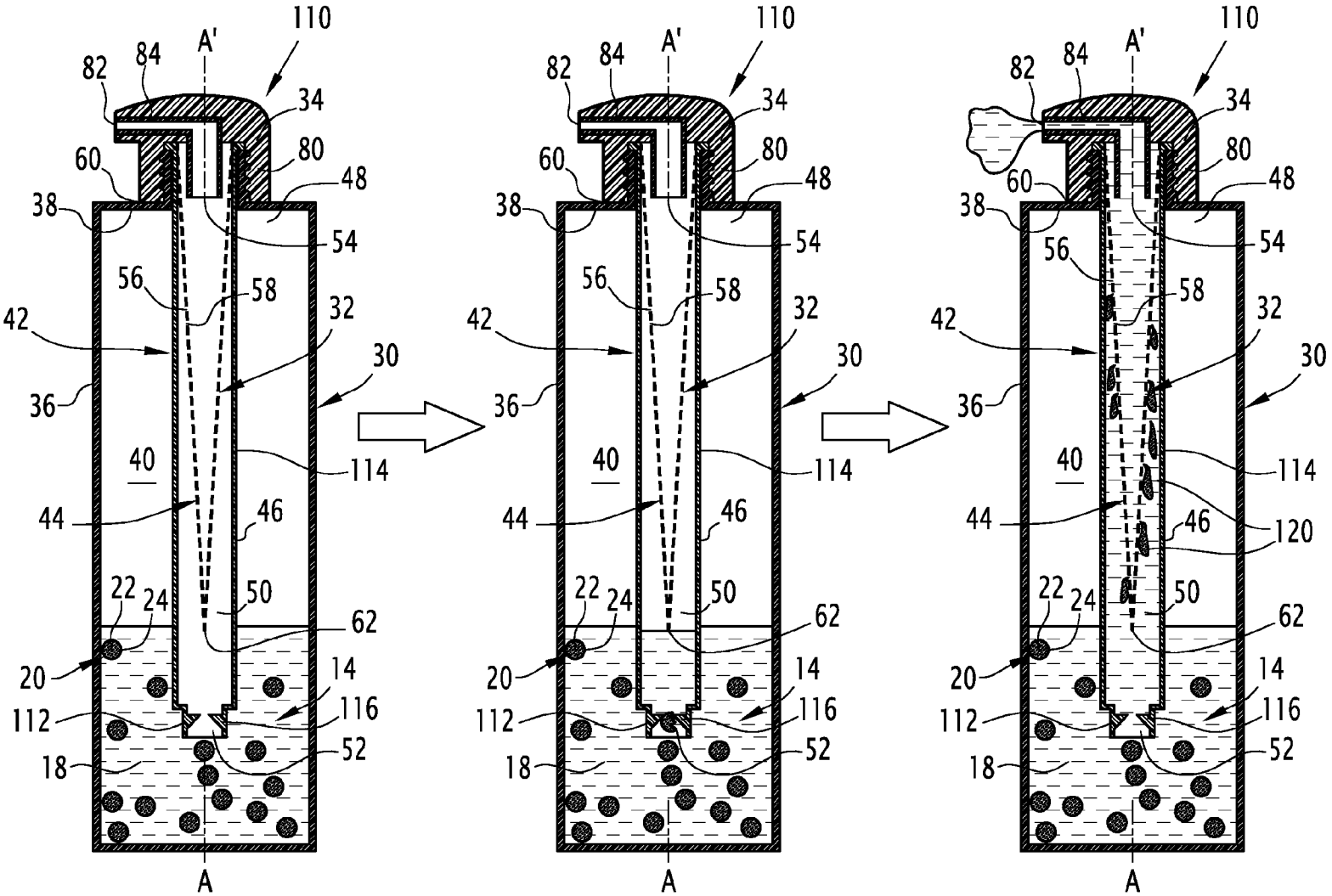
FIG. 3 is a view similar to FIG. 1 of a second dispensing device.
FIG. 4 is a view similar to FIG. 3 of the second dispensing device during the rupture of the dispersed particles.
FIG. 5 is a view similar to FIG. 2 of the second dispensing device.

As illustrated in FIG. 3, the free end 62 of the openwork filtration wall 56 is axially separated from the upstream opening 52.

The invention claimed is:

1. A device for dispensing a fluid composition, comprising:

a container containing a heterogeneous mixture;

a delivery element positioned in the container, to convert the heterogeneous mixture into the fluid composition;

a dispenser for dispensing the fluid composition outside the device;

the delivery element comprising:

a fluid guide conduit, comprising an upstream opening designed to open into the container, a central passage, and a downstream opening connected to the dispenser, the guide conduit defining a fluid flow axis through the central passage between the upstream opening and the downstream opening;

a filtration member, mounted in the guide conduit, the filtration member being configured so that the heterogeneous mixture flowing into the guide conduit through the upstream opening passes through the filtration member;

the filtration member comprising at least one openwork filtration wall delimiting a plurality of filtration openings, the filtration wall forming a non-zero angle with a perpendicular to the flow axis;

the guide conduit has an upstream restrictor, positioned between the upstream opening and the filtration member, the guide conduit having a downstream segment with a transverse expanse, considered relative to the flow axis, larger than the transverse expanse of the upstream restrictor;

the heterogeneous mixture comprising particles in suspension, the filtration openings having a transverse expanse smaller than the mean diameter of the particles in suspension, and the particles in suspension being formed by beads comprising a core and a gelled envelope.

2. The device according to claim 1, wherein the filtration wall is inclined relative to a perpendicular to the flow axis.

3. The device according to claim 2, wherein the filtration member assumes a conical or frustoconical shape with an axis parallel to or combined with the flow axis.

4. The device according to claim 1, wherein the filtration wall extends along the flow axis.

5. The device according to claim 4, wherein the filtration wall is cylindrical, with an axis parallel to or combined with the flow axis.

6. The device according to claim 1, wherein each filtration opening has a size larger than 0.1 mm.

7. The device according to claim 1, wherein the dispensing member is a pump.

8. The device according to claim 1, wherein the transverse expanse of each filtration opening is smaller than one third of the mean diameter of the particles in suspension.

9. The device according to claim 1, wherein the filtration openings have an elongated shape.

10. The device according to claim 1, wherein the volume of an upstream part of the central passage situated upstream from the filtration member in the central passage is greater than a maximum volume of all residues recovered during a disintegration of the particles in suspension.

11. The device according to claim 1, wherein the surface area of each filtration opening is smaller than a minimum surface area of each residue from among all of the residues recovered during a disintegration of all of the particles in suspension.

12. The device according to claim 1, wherein the total surface area of the filtration openings is greater than 0.2%, of a total surface area of the residues recovered during a disintegration of all of the particles in suspension.

13. A method for dispensing a fluid composition, comprising the following steps:

providing a device according to claim 1, containing a heterogeneous mixture;

actuating the dispensing member to drive the heterogeneous mixture into the delivery element;

converting the heterogeneous mixture into the fluid composition in the filtration member;

dispensing the fluid composition through the dispensing member outside the device.

14. The method according to claim 13, wherein the heterogeneous mixture comprises particles in suspension, the method comprising the disintegration of the particles in suspension in the delivery element to obtain the fluid composition.

15. The method according to claim 14, wherein the disintegration of the particles in suspension is done before the passage in the filtration member, the disintegration of the particles in suspension comprising the formation of a residue, the residue being retained on the filtration member.

16. The device according to claim 7, wherein the pump is selected from the group consisting of a membrane pump and a piston pump.

17. The device according to claim 1, wherein the transverse expanse of each filtration opening is smaller than one quarter of the mean diameter of the particles in suspension.

18. A delivery element for converting a heterogeneous mixture into a fluid composition and positioned in a container containing the heterogeneous mixture, the delivery element comprising:

a fluid guide conduit, comprising an upstream opening designed to open into the container, a central passage, and a downstream opening designed to be connected to a dispenser for dispensing the fluid composition outside the container, the guide conduit defining a fluid flow axis through the central passage between the upstream opening and the downstream opening;

a filtration member, mounted in the guide conduit, the filtration member being configured so that the heterogeneous mixture flowing into the guide conduit through the upstream opening passes through the filtration member;

the filtration member comprising at least one openwork filtration wall delimiting a plurality of filtration openings, the filtration wall forming a non-zero angle with a perpendicular to the flow axis;

wherein the guide conduit has an upstream restrictor, positioned between the upstream opening and the filtration member, the guide conduit having a downstream segment with a transverse expanse, considered relative to the flow axis, larger than the transverse expanse of the upstream restrictor; and wherein the upstream restrictor comprises an inner radial protrusion.

19. The delivery element according to claim 18, wherein the inner radial projection is annular.

* * * * *